US011587573B2

(12) United States Patent
Chen et al.

(10) Patent No.: US 11,587,573 B2
(45) Date of Patent: Feb. 21, 2023

(54) SPEECH PROCESSING METHOD AND DEVICE THEREOF

(71) Applicant: Acer Incorporated, New Taipei (TW)

(72) Inventors: Chao-Lun Chen, New Taipei (TW); An-Cheng Lee, New Taipei (TW); Li-Wei Huang, New Taipei (TW)

(73) Assignee: Acer Incorporated, New Taipei (TW)

( * ) Notice: Subject to any disclaimer, the term of this patent is extended or adjusted under 35 U.S.C. 154(b) by 611 days.

(21) Appl. No.: 16/698,969

(22) Filed: Nov. 28, 2019

(65) Prior Publication Data

US 2021/0082446 A1 Mar. 18, 2021

(30) Foreign Application Priority Data

Sep. 17, 2019 (TW) ..... 108133424

(51) Int. Cl.
*G10L 19/00* (2013.01)
*G10L 19/087* (2013.01)
(Continued)

(52) U.S. Cl.
CPC ..... *G10L 19/087* (2013.01); *G10L 19/06* (2013.01); *G10L 25/60* (2013.01)

(58) Field of Classification Search
CPC ..... G10L 19/00; G10L 21/0208; G10L 19/24; G10L 19/0204; G10L 19/26;
(Continued)

(56) References Cited

U.S. PATENT DOCUMENTS 5,963,897 A * 10/1999 Alpuente ..... G10L 19/13 704/E19.041
5,991,717 A * 11/1999 Minde ..... G10L 19/10 704/223
(Continued)

FOREIGN PATENT DOCUMENTS

CN 101185126 5/2008
CN 103050121 4/2013
(Continued)

OTHER PUBLICATIONS

McCree, A., Truong, K., George, E. B., Barnwell, T. P., & Viswanathan, V. (May 1996). A 2.4 kbit/s MELP coder candidate for the new US Federal Standard. In 1996 IEEE International Conference on Acoustics, Speech, and Signal Processing Conference Proceedings (vol. 1, pp. 200-203). IEEE. (Year: 1996).*
(Continued)

*Primary Examiner* — Edgar X Guerra-Erazo
(74) *Attorney, Agent, or Firm* — JCIPRNET

(57) ABSTRACT

The disclosure provides a speech processing method and a device thereof. The method includes: acquiring a speech sampling signal frame in a mixed-excitation linear prediction (MELP) speech coding system and estimating signal quality of the speech sampling signal frame; determining, based on the signal quality, a specific linear prediction coding (LPC) order used by an LPC circuit; controlling the LPC circuit to convert the speech sampling signal frame into a line spectrum pair parameter based on the specific LPC order; replacing a speech signal spectrum of the speech sampling signal frame with the line spectrum pair parameter to generate a predicted speech signal; and performing a speech coding operation and a signal synthesizing operation of the MELP speech coding system based on the predicted speech signal.

13 Claims, 3 Drawing Sheets

(51) Int. Cl.
*G10L 19/06* (2013.01)
*G10L 25/60* (2013.01)

(58) Field of Classification Search
CPC ..... G10L 19/265; G10L 19/008; G10L 19/06; G10L 19/12; G10L 19/09; G10L 2025/935; G10L 25/90; G10L 15/02; G10L 19/005; G10L 19/03; G10L 19/20; G10L 21/02; G10L 19/0208; G10L 19/02; G10L 19/087; G10L 19/093; G10L 19/18; G10L 19/10; G10L 2019/0011; G10L 25/21; G10L 19/04; G10L 2019/0002; G10L 19/07; G10L 19/083; G10L 19/097; G10L 19/173; G10L 19/22; G10L 19/125; G10L 19/13; G10L 19/16; G10L 19/028
See application file for complete search history.

(56) References Cited

U.S. PATENT DOCUMENTS 6,466,904 B1 * 10/2002 Gao ..... G10L 19/02 704/E19.01
8,126,707 B2 * 2/2012 Ertan ..... G10L 19/005 704/219
8,768,690 B2 * 7/2014 Gupta ..... G10L 19/22 704/207
9,208,775 B2 * 12/2015 Subasingha ..... G10L 19/005
2002/0052734 A1 5/2002 Unno et al.
2008/0249768 A1 * 10/2008 Ertan ..... G10L 19/005 704/219
2012/0327243 A1 12/2012 Rezvani
2014/0236585 A1 * 8/2014 Subasingha ..... G10L 19/10 704/207

FOREIGN PATENT DOCUMENTS

TW 200705387 2/2007
TW 201243828 11/2012

OTHER PUBLICATIONS

Duta, C. L., Gheorghe, L., & Tapus, N. (Sep. 2015). Real time implementation of MELP speech compression algorithm using Blackfin processors. In 2015 9th International Symposium on Image and Signal Processing and Analysis (ISPA) (pp. 250-255). IEEE. (Year: 2015).*

M. W. Chamberlain, "A 600 bps MELP vocoder for use on HF channels," 2001 MILCOM Proceedings Communications for Network-Centric Operations: Creating the Information Force (Cat. No. 01CH37277), 2001, pp. 447-453 vol. 1. (Year: 2001).*

M. Z. Markovic, "Speech compression—recent advances and standardization," 5th International Conference on Telecommunications in Modern Satellite, Cable and Broadcasting Service. TELSIKS 2001. Proceedings of Papers (Cat. No. 01EX517), 2001, pp. 235-244 vol. 1. (Year: 2001).*

Kalbkhani, H., Yousefi, S., & Shayesteh, M. G. (2014). Adaptive handover algorithm in heterogeneous femtocellular networks based on received signal strength and signal-to-interference-plus-noise ratio prediction. IET Communications, 8(17), 3061-3071. (Year: 2014).*

* cited by examiner

SPEECH PROCESSING METHOD AND DEVICE THEREOF

CROSS-REFERENCE TO RELATED APPLICATION

This application claims the priority benefit of Taiwan application serial no. 108133424, filed on Sep. 17, 2019. The entirety of the above-mentioned patent application is hereby incorporated by reference herein and made a part of this specification.

BACKGROUND

Technical Field

The disclosure generally relates to a speech processing method and a device thereof, and in particular, to a speech processing method and a device thereof for adaptively adjusting a linear prediction coding (LPC) order.

Description of Related Art

The development trend of the 5th generation (5G) mobile communication has driven up related industrial applications of Internet of Things (IoT), and especially applications in low power and low transmission rate.

A mixed-excitation linear prediction (MELP) speech coding system is a low-bit rate speech coding and decoding system, which is widely used in multi-digital broadcasting, wireless communication and network systems. However, for the mobile communication and the related applications of the IoT, the MELP speech coding system does not take signal quality in an actual environment into consideration, resulting in a poor speech synthesizing effect caused by excessive noise interference during reconstruction and synthesis of a speech signal. Moreover, the distortion rate caused by this method also has a negative impact on the speech quality.

SUMMARY

In view of this, the disclosure provides a speech processing method and device thereof, which may be configured to solve the above technical problems.

The disclosure provides a speech processing method, and the method includes the following steps. A speech sampling signal frame is acquired in a mixed-excitation linear prediction (MELP) speech coding system, and signal quality of the speech sampling signal frame is estimated. The MELP speech coding system includes a linear prediction coding (LPC) circuit. Based on the signal quality, a specific LPC order used by the LPC circuit is determined. The LPC circuit is controlled to convert the speech sampling signal frame into a line spectrum pair parameter based on the specific LPC order. A speech signal spectrum of the speech sampling signal frame is replaced with the line spectrum pair parameter to generate a predicted speech signal. A speech coding operation and a signal synthesizing operation of the MELP speech coding system are performed based on the predicted speech signal.

The disclosure provides a speech processing device, including a mixed-excitation linear prediction (MELP) speech coding system, a storage circuit and a processor. The storage circuit stores a plurality of modules. The processor is coupled to the storage circuit, and accesses the above modules to perform the following steps. A speech sampling signal frame is acquired in the MELP speech coding system, and signal quality of the speech sampling signal frame is estimated. The MELP speech coding system includes a linear prediction coding (LPC) circuit. Based on the signal quality, a specific LPC order used by the LPC circuit is determined. The LPC circuit is controlled to convert the speech sampling signal frame into a line spectrum pair parameter based on the specific LPC order. A speech signal spectrum of the speech sampling signal frame is replaced with the line spectrum pair parameter to generate a predicted speech signal. A speech coding operation and a signal synthesizing operation of the MELP speech coding system are performed based on the predicted speech signal.

Based on the above, the method and the device thereof of the disclosure can adaptively determine the used LPC order according to the signal quality of the speech sampling signal frame, so that the subsequent speech coding and signal synthesizing effect can be improved, and the audio quality is increased.

In order to make the aforementioned and other objectives and advantages of the disclosure comprehensible, embodiments accompanied with figures are described in detail below.

DESCRIPTION OF THE EMBODIMENTS

Figure 1:
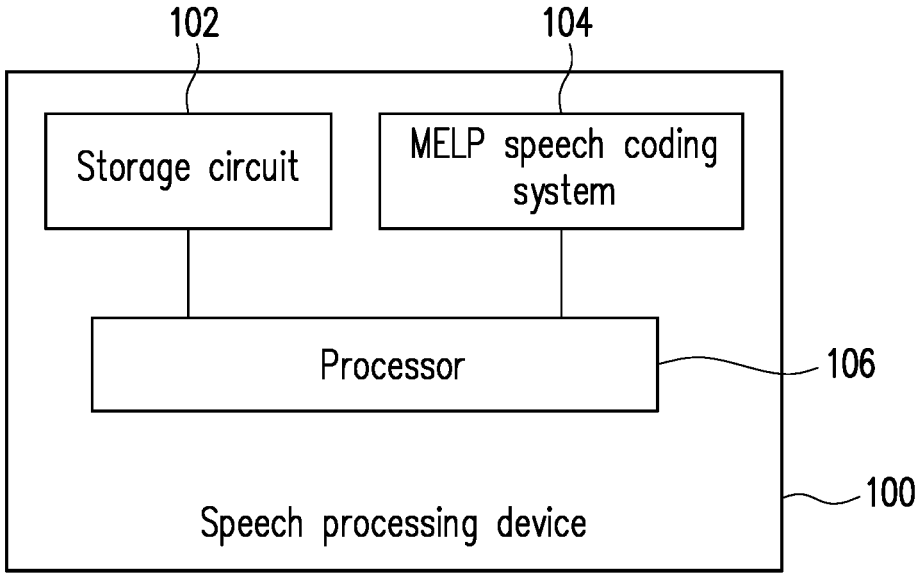
FIG. 1 is a schematic diagram illustrating a speech processing device according to an embodiment of the disclosure.

Referring to FIG. 1, FIG. 1 is a schematic diagram illustrating a speech processing device according to an embodiment of the disclosure. As shown in FIG. 1, a speech processing device 100 includes a storage circuit 102, a mixed-excitation linear prediction (MELP) speech coding system 104 and a processor 106. In different embodiments, the speech processing device 100 is, for example, an Internet of Things (IoT) device (such as a narrow band IoT (NB-IoT) device) configured to receive a speech signal and perform a desired signal processing operation on the speech signal, or a portable mobile communication device configured to perform low bit rate and low power audio coding and decoding, but the disclosure may not be limited thereto.

In different embodiments, the storage circuit 102 is, for example, any type of fixed or mobile random access memory (RAM), a read-only memory (ROM), a flash memory, a hard disk or other similar devices or a combination of these devices, and may be configured to record a plurality of program codes or modules.

The processor 106 is coupled to the storage circuit 102 and the MELP speech coding system 104, and may be a general-purpose processor, a special-purpose processor, a conventional processor, a digital signal processor, a plurality of microprocessors, one or more microprocessors combined with a digital signal processor core, a controller, a micro controller, an application-specific integrated circuit (ASIC), a field programmable gate array (FPGA), any other types of integrated circuits, a state machine, a processor based on an advanced RISC machine (ARM), and a similar product.

In the embodiment of the disclosure, the processor 106 may access the modules and the program codes which are recorded in the storage circuit 102 to implement the speech processing method provided by the disclosure. In general terms, the speech processing device 100 of the disclosure may use the MELP speech coding system 104 to process a received speech signal, but a linear prediction coding (LPC) order used by an LPC circuit in the MELP speech coding system 104 is adaptively determined on the basis of signal quality of the speech signal. Therefore, the effects of subsequent speech coding and synthesizing operations may be improved, and the audio quality is increased. Details are described below.

Figure 2:
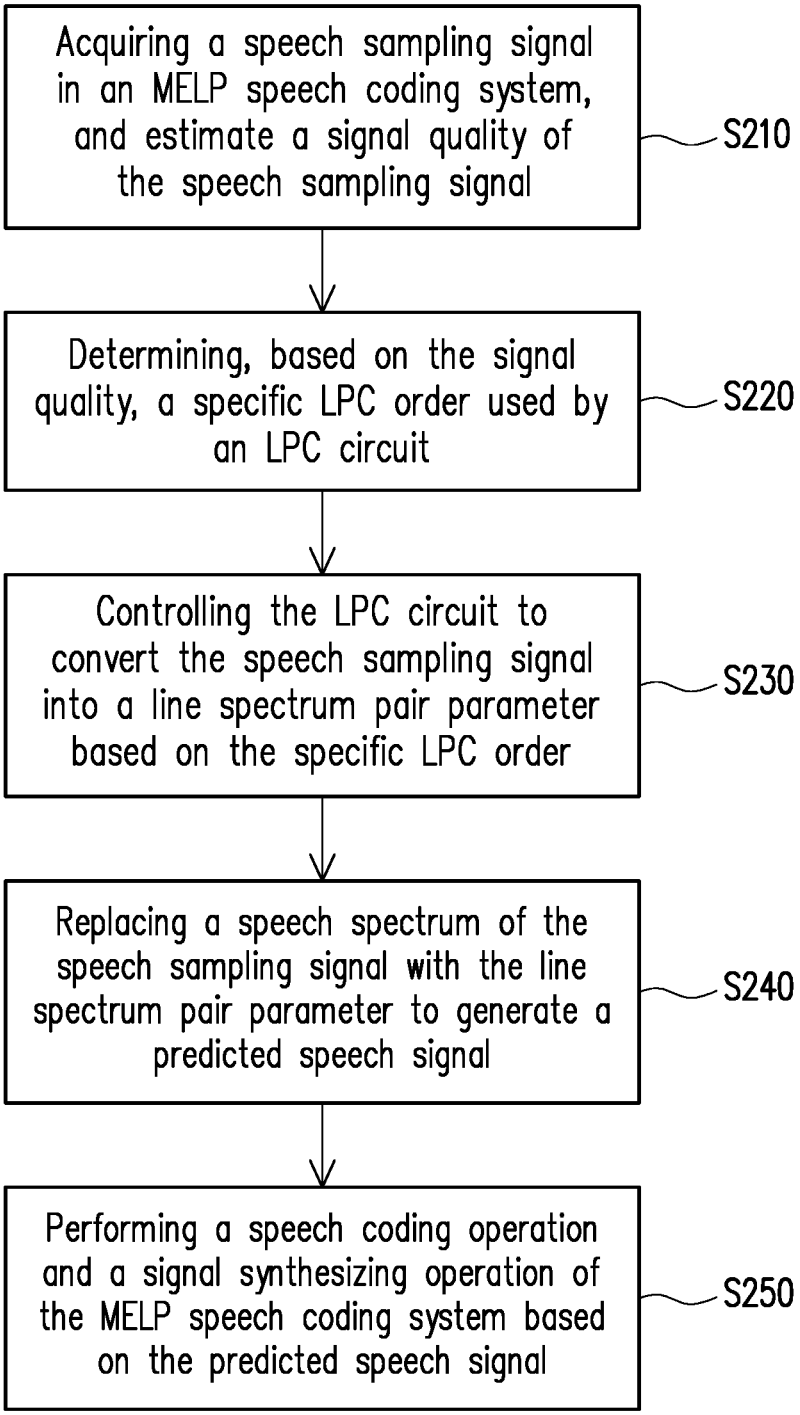
FIG. 2 is a flow chart illustrating a speech processing method according to an embodiment of the disclosure.

Referring to FIG. 2, FIG. 2 is a flow chart illustrating a speech processing method according to an embodiment of the disclosure. The method of the present embodiment may be implemented by the speech processing device 100 of FIG. 1. Details of all steps of FIG. 2 are described below in conjunction with the elements shown in FIG. 1.

First, in step S210, in the MELP speech coding system 104, the processor 106 may acquire a speech sampling signal frame and estimates signal quality of the speech sampling signal frame. In the present embodiment, the speech sampling signal frame may, for example, include a plurality of sampling signals generated by sampling, by the processor 106, an analog speech signal input by a user. Furthermore, the signal quality of the speech sampling signal frame may be estimated, for example, through signal quality estimation unit disposed in the MELP speech coding system 104, and may be represented as a signal to interference plus noise ratio (SINR) of the speech sampling signal frame, but the disclosure may not be limited thereto.

Then, in step S220, the processor 160 may determine, based on the signal quality, a specific LPC order used by the LPC circuit. In the present embodiment, the designer may pre-set predetermined signal quality ranges corresponding to different signal qualities, and the respective predetermined signal quality ranges may correspond to different LPC orders. Furthermore, an LPC order corresponding to a larger one of the predetermined signal quality ranges may be greater than that corresponding to a smaller one of the predetermined signal quality ranges. Under this circumstance, the processor 106 may find out a specific signal quality range, to which the above signal quality belongs, from the plurality of predetermined signal quality ranges, and take an LPC order corresponding to the specific signal quality range as the above specific LPC order.

In one embodiment, the predetermined signal quality ranges and the corresponding LPC orders thereof may be exemplified as forms in Table 1 below.

TABLE 1

| Predetermined signal quality range | LPC order |
|---|---|
| SINR (dB) > 25 | 20 |
| 16 < SINR (dB) < 25 | 16 |
| 11 < SINR (dB) < 15 | 10 |
| SINR (dB) < 10 | 8 |

As shown in Table 1, if the SINR of the speech sampling signal frame is more than 25 dB, the LPC order corresponding thereto is, for example, 20. If the SINR of the speech sampling signal frame is between 16 dB and 25 dB, the LPC order corresponding thereto is, for example, 16. If the SINR of the speech sampling signal frame is between 11 dB and 15 dB, the LPC order corresponding thereto is, for example, 10. If the SINR of the speech sampling signal frame is less than 10 dB, the LPC order corresponding thereto is, for example, 8. But the disclosure may not be limited thereto.

Therefore, in different embodiments, if the SINR of the speech sampling signal frame is more than 25 dB, the processor 106 may determine, based on Table 1, that the specific LPC order of the LPC circuit is 20. If the SINR of the speech sampling signal frame is between 16 dB and 25 dB, the processor 106 may determine, based on Table 1, that the specific LPC order of the LPC circuit is 16. If the SINR of the speech sampling signal frame is between 11 dB and 15 dB, the processor 106 may determine, based on Table 1, that the specific LPC order of the LPC circuit is 10. If the SINR of the speech sampling signal frame is less than 10 dB, the processor 106 may determine, based on Table 1, that the specific LPC order of the LPC circuit is 8. But the disclosure may not be limited thereto.

In step S230, the processor 106 may control the LPC circuit to convert the speech sampling signal frame into a line spectrum pair parameter based on the specific LPC order.

In one embodiment, the processor 106 may determine whether the signal quality of the speech sampling signal frame is greater than a predetermined threshold. If so, the processor 106 may control the LPC circuit to convert the speech sampling signal frame into the line spectrum pair parameter based on a first solution. If not, the processor 106 may control the LPC circuit to convert the speech sampling signal frame into the line spectrum pair parameter based on a second solution. The first solution and the second solution are used to generate a prediction error in different manners.

In different embodiments, the above predetermined threshold may be set according to a demand of the designer. For facilitating the description, the predetermined threshold is set to 15 dB, but it is merely for illustration, and is not used to limit the possible implementations of the disclosure. Based on this, Table 1 may be correspondingly adjusted into forms in Table 2 below.

TABLE 2

| Predetermined signal quality range | LPC order | Solution |
|---|---|---|
| SINR (dB) > 25 | 20 | First solution |
| 16 < SINR (dB) < 25 | 16 | |
| 11 < SINR (dB) < 15 | 10 | Second solution |
| SINR (dB) < 10 | 8 | |

If the processor 106 controls the LPC circuit to convert the speech sampling signal frame into the line spectrum pair parameter based on the first solution, the processor 106 may first acquire an estimated signal corresponding to the speech sampling signal frame, and subtract the estimated signal ($\tilde{s}(n)$) from the speech sampling signal frame (represented by $s(n)$) to generate a prediction error (represented by $e(n)$).

In one embodiment, the estimated signal in the first solution may be represented as: $\tilde{s}(n)=\Sigma_{k=1}^{P}a_k s(n-k)$ where $a_k$ is a prediction coefficient, P is the specific LPC order, and $-\infty<n<+\infty$. Under this circumstance, the prediction error may be represented as "$e(n)=s(n)-\tilde{s}(n)$".

In addition, in another embodiment, the estimated signal in the second solution may be represented as: $\tilde{s}(n)=-\Sigma_{k=1}^{P}a_k s(n-k)$, where $-a_k$ is a prediction coefficient, P is the specific LPC order, and $-\infty<n<+\infty$. Under this circumstance, the prediction error may be represented as "$e(n)=s(n)+\tilde{s}(n)$".

Later, the processor 106 may generate, based on the prediction error and the specific LPC order, the line spectrum pair parameter by using a Levinson-Durbin algorithm.

In the present embodiment, related details of the Levinson-Durbin algorithm corresponding to the first solution and the second solution may be summarized into Table 3 below.

TABLE 3

| | First solution (Prediction coefficient: $a_k$) | Second solution (Prediction coefficient: $-a_k$) |
|---|---|---|
| Estimated signal | $\tilde{s}(n) = \sum_{k=1}^{P} a_k s(n-k)$ | $\tilde{s}(n) = -\sum_{k=1}^{P} a_k s(n-k)$ |
| Prediction error | $e(n) = s(n) - \tilde{s}(n)$ | $e(n) = s(n) + \tilde{s}(n)$ |
| Levinson-Durbin algorithm | $E^{(0)} = R_0 = \sum_{n=-\infty}^{\infty} e^2(n)$ | $E^{(0)} = R_0 = \sum_{n=-\infty}^{\infty} e^2(n)$ |
| | $K_i = \frac{R_i - \sum_{j=1}^{i-1} a_j^{(i-1)} R_{i-j}}{E^{(i-1)}}, 1 \le i \le P$ | $K_i = -\frac{R_i + \sum_{j=1}^{i-1} a_j^{(i-1)} R_{i-j}}{E^{(i-1)}}, 1 \le i \le P$ |
| | $a_i^{(i)} = K_i$<br>$a_j^{(i)} = a_j^{(i-1)} - K_i a_{i-j}^{(i-1)}, 1 \le j \le i-1$<br>$E^{(i)} = (1 - K_i^2) E^{(i-1)}$ | $a_i^{(i)} = K_i$<br>$a_j^{(i)} = a_j^{(i-1)} + K_i a_{i-j}^{(i-1)}, 1 \le j \le i-1$<br>$E^{(i)} = (1 - K_i^2) E^{(i-1)}$ |
| Line spectrum pair parameter | $\overline{M}_l = \frac{G}{1 - \sum_{k=1}^{P} a_k e^{-j(l+1)\omega_0 k}}$ | $\overline{M}_l = \frac{G}{1 + \sum_{k=1}^{P} a_k e^{-j(l+1)\omega_0 k}}$ |

In Table 3, $E^{(0)}$ is, for example, a minimum mean square error, and G and $R_i$ ($0 \le i \le P$) are, for example, gain parameters, but the disclosure may be not limited thereto.

Next, in step S240, the processor 106 may replace a speech spectrum of the speech sampling signal frame with the line spectrum pair parameter to generate a predicted speech signal. Furthermore, in step S250, the processor 106 may perform a speech coding operation and a signal synthesizing operation of the MELP speech coding system based on the predicted speech signal. In the embodiment of the disclosure, step S250 may refer to the related description file for the MELP speech coding system in the prior art, and descriptions thereof are omitted herein.

From the foregoing, since the disclosure may adaptively determine the LPC order used (which is positively related to the signal quality of the speech sampling signal frame) according to the signal quality of the speech sampling signal frame, the subsequent speech coding and signal synthesizing effect may be improved, and the audio quality is increased.

From another point of view, the concept of the disclosure may be broadly understood as adjusting the LPC circuit in the conventional MELP speech coding system to be operated adaptively according to the LPC order corresponding to the signal quality, rather than a fixed LPC order. Other circuits for the MELP speech coding system include, for example, a prefilter, a pitch search circuit, a bandpass voicing decision circuit, a gain calculation circuit, a final pitch and voicing determination circuit, a line spectrum frequency quantization circuit, a gain/pitch/voicing/jitter quantization circuit, a Fourier magnitude calculation circuit, a forward error correction circuit and the like, and the LPC circuit of the disclosure may be disposed, for example, between the gain calculation circuit and the final pitch and voicing determination circuit, but is not limited thereto. In this way, if the signal quality of the speech sampling signal frame is lower, the disclosure may accordingly adopt a lower LPC order, thereby avoiding the reduction of the audio quality due to interpolation of excessive noise during the operation of the LPC circuit, and reducing the related computation amount at the same time. On the other hand, if the signal quality of the speech sampling signal frame is higher, the disclosure may accordingly adopt a higher LPC order, thereby correspondingly improving the subsequent audio quality (e.g., lower spectral distortion).

In addition, in the embodiment of performing the Levinson-Durbin algorithm in the second solution, since the prediction error is represented as "$e(n)=s(n)+\tilde{s}(n)$", the absolute value calculation with a higher computation amount may be avoided in the subsequent calculation process. Therefore, the overall computation amount may be effectively reduced, and the delay in calculation may be reduced.

Figure 3:
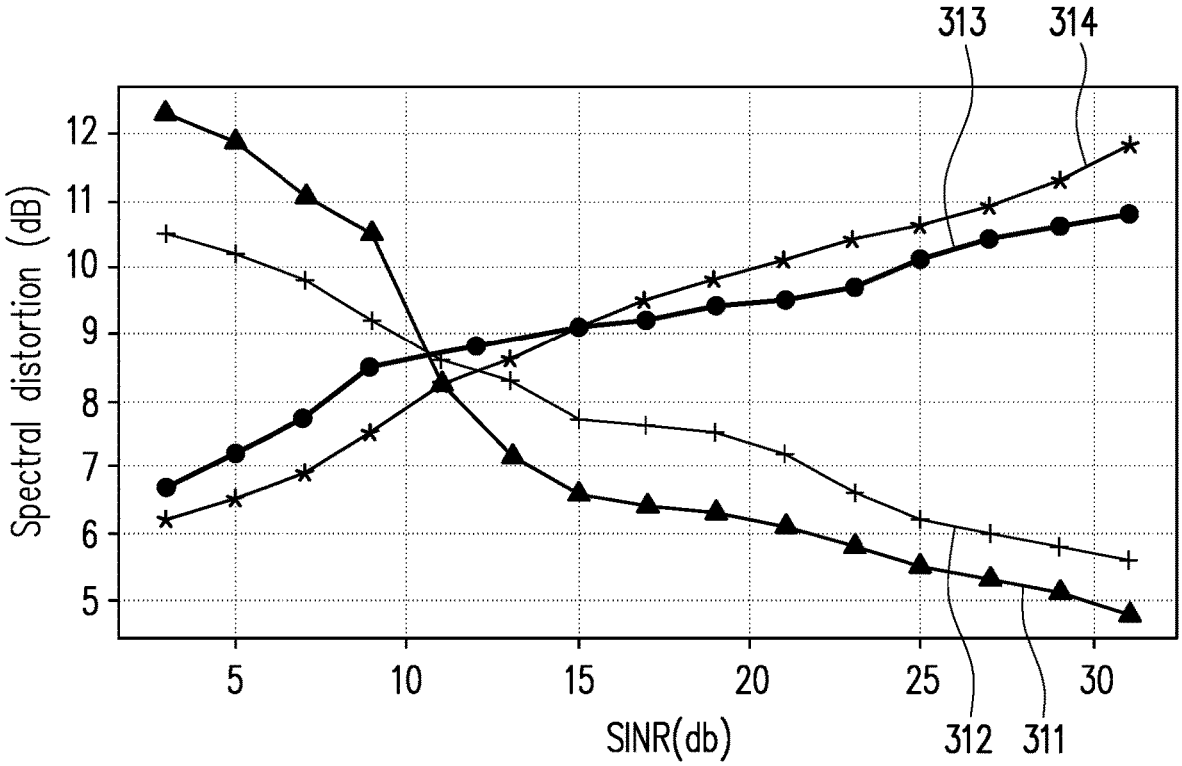
FIG. 3 is a spectral distortion diagram obtained by operation of a linear prediction coding (LPC) circuit based on a fixed LPC order according to an embodiment of the disclosure.

In addition, in order to support the effect of the disclosure, a further description will be made with reference to FIG. 3. Referring to FIG. 3, it is a spectral distortion diagram obtained by operation of a linear prediction coding (LPC) circuit based on a fixed LPC order according to an embodiment of the disclosure. In the present embodiment, curves 311 to 314 correspond to LPC orders 20, 16, 10 and 8, respectively. It can be seen from FIG. 3 that when the SINR is lower (for example, less than 11 dB), use of a higher LPC order may result in higher spectral distortion due to interpolation of excessive noise, while use of a lower LPC order may achieve lower spectral distortion. Moreover, when the SINR is higher (for example, more than 11 dB), use of a higher LPC order may result in lower spectral distortion due to a better learning effect, while use of a lower LPC order may result in higher spectral distortion due to a poor learning effect.

It can be seen that if only the fixed LPC order is used, a better spectral distortion performance may not be achieved in response to various signal qualities. In contrast, since the method and device of the disclosure may adaptively adopt different LPC orders in response to the signal qualities, the better spectral distortion performance may be achieved.

FIG. 3 is taken as an example. The designer may set a predetermined signal quality range having the SINR more than 11 dB to correspond to the higher LPC order (e.g., 20 and/or 16), and set a predetermined signal quality range having the SINR less than 11 dB to correspond to the lower LPC order (e.g., 10 and/or 8). In this way, the disclosure may use the lower LPC order (e.g., 10 and/or 8) when the SINR is lower (e.g., less than 11 dB) and use the higher LPC order (e.g., 20 and/or 16) when the SINR is higher (e.g., more than 11 dB), thereby providing higher audio quality in response to different signal qualities.

Based on the above, the disclosure may adaptively determine the used LPC order (which is positively related to the signal quality of the speech sampling signal frame) according to the signal quality of the speech sampling signal frame, so that the subsequent speech coding and signal synthesizing effect may be improved, and the audio quality is increased.

Furthermore, the disclosure may further select the first solution or the second solution in response to the signal quality to perform the Levinson-Durbin algorithm to acquire the line spectrum pair parameter, thereby further reducing the computation amount and lowering the delay required by computation.

Although the disclosure is described with reference to the above embodiments, the embodiments are not intended to limit the disclosure. A person of ordinary skill in the art may make variations and modifications without departing from the spirit and scope of the disclosure. Therefore, the protection scope of the disclosure should be subject to the appended claims.

What is claimed is:

1. A speech processing method, comprising:

acquiring a speech sampling signal frame in a mixed-excitation linear prediction speech coding system and estimating signal quality of the speech sampling signal frame, wherein the mixed-excitation linear prediction speech coding system comprises a linear prediction coding circuit;

determining, based on the signal quality, a specific linear prediction coding order used by the linear prediction coding circuit, wherein the step of determining the specific linear prediction coding order used by the linear prediction coding circuit based on the signal quality comprises:

determining a specific signal quality range, to which the signal quality belongs, of a plurality of predetermined signal quality ranges, wherein the predetermined signal quality ranges correspond to different linear prediction coding orders, and an linear prediction coding order corresponding to a larger one of the predetermined signal quality ranges is greater than that corresponding to a smaller one of the predetermined signal quality ranges; and taking a linear prediction coding order corresponding to the specific signal quality range as the specific linear prediction coding order;

controlling the linear prediction coding circuit to convert the speech sampling signal frame into a line spectrum pair parameter based on the specific linear prediction coding order;

replacing a speech signal spectrum of the speech sampling signal frame with the line spectrum pair parameter to generate a predicted speech signal; and performing a speech coding operation and a signal synthesizing operation of the mixed-excitation linear prediction speech coding system based on the predicted speech signal.

2. The method according to claim 1, wherein the signal quality is represented as a signal to interference plus noise ratio of the speech sampling signal frame.

3. The method according to claim 1, wherein the step of controlling the linear prediction coding circuit to convert the speech sampling signal frame into the line spectrum pair parameter based on the specific linear prediction coding order comprises:

in response to determining that the signal quality of the speech sampling signal frame is greater than a predetermined threshold, controlling the linear prediction coding circuit to convert the speech sampling signal frame into the line spectrum pair parameter based on a first solution.

4. The method according to claim 3, further comprising:

in response to determining that the signal quality of the speech sampling signal frame is not greater than the predetermined threshold, controlling the linear prediction coding circuit to convert the speech sampling signal frame into the line spectrum pair parameter based on a second solution, wherein the first solution and the second solution are used to generate a prediction error in different manners.

5. The method according to claim 3, wherein the step of controlling the linear prediction coding circuit to convert the speech sampling signal frame into the line spectrum pair parameter based on the first solution comprises:

acquiring an estimated signal corresponding to the speech sampling signal frame and subtracting the estimated signal from the speech sampling signal frame to generate the prediction error; and generating, based on the prediction error and the specific linear prediction coding order, the line spectrum pair parameter by using a Levinson-Durbin algorithm.

6. The method according to claim 3, wherein the step of controlling the linear prediction coding circuit to convert the speech sampling signal frame into the line spectrum pair parameter based on the second solution comprises:

acquiring an estimated signal corresponding to the speech sampling signal frame and summating the speech sampling signal frame and the estimated signal to generate the prediction error; and generating, based on the prediction error and the specific linear prediction coding order, the line spectrum pair parameter.

7. The method according to claim 6, wherein the step of generating, based on the prediction error and the specific linear prediction coding order, the line spectrum pair parameter comprises:

generating, based on the prediction error and the specific linear prediction coding order, the line spectrum pair parameter by using a Levinson-Durbin algorithm.

8. A speech processing device, comprising:

a mixed-excitation linear prediction speech coding system;

a storage circuit, configured to store a plurality of modules; and a processor, coupled to the storage circuit and accessing the modules to perform the following steps:

acquiring a speech sampling signal frame in the mixed-excitation linear prediction speech coding system and estimating signal quality of the speech sampling signal frame, wherein the mixed-excitation linear prediction speech coding system comprises a linear prediction coding circuit;

determining, based on the signal quality, a specific linear prediction coding order used by the linear prediction coding circuit, wherein the processor is configured to:

determine a specific signal quality range, to which the signal quality belongs, of a plurality of predetermined signal quality ranges, wherein the predetermined signal quality ranges correspond to different linear prediction coding orders, and an linear prediction coding order corresponding to a larger one of the predetermined signal quality ranges is greater than that corresponding to a smaller one of the predetermined signal quality ranges; and take a linear prediction coding order corresponding to the specific signal quality range as the specific linear prediction coding order;

controlling the linear prediction coding circuit to convert the speech sampling signal frame into a line spectrum pair parameter based on the specific linear prediction coding order;

replacing a speech signal spectrum of the speech sampling signal frame with the line spectrum pair parameter to generate a predicted speech signal; and performing a speech coding operation and a signal synthesizing operation of the mixed-excitation linear prediction speech coding system based on the predicted speech signal.

9. The speech processing device according to claim 8, wherein the signal quality is represented as a signal to interference plus noise ratio of the speech sampling signal frame.

10. The speech processing device according to claim 8, wherein the processor is configured to:

in response to determining that the signal quality of the speech sampling signal frame is greater than a predetermined threshold, control the linear prediction coding circuit to convert the speech sampling signal flame into the line spectrum pair parameter based on a first solution.

11. The speech processing device according to claim 10, wherein in response to determining that the signal quality of the speech sampling signal frame is not greater than the predetermined threshold, the processor is further configured to control the linear prediction coding circuit to convert the speech sampling signal frame into the line spectrum pair parameter based on a second solution, wherein the first solution and the second solution are used to generate a prediction error in different manners.

12. The speech processing device according to claim 10, wherein the processor is configured to:

acquire an estimated signal corresponding to the speech sampling signal frame and subtracting the estimated signal from the speech sampling signal frame to generate the prediction error; and generate, based on the prediction error and the specific linear prediction coding order, the line spectrum pair parameter by using a Levinson-Durbin algorithm.

13. The speech processing device according to claim 10, wherein the processor is configured to:

acquire an estimated signal corresponding to the speech sampling signal frame and summating the speech sampling signal frame and the estimated signal to generate the prediction error; and generate, based on the prediction error and the specific linear prediction coding order, the line spectrum pair parameter by using a Levinson-Durbin algorithm.

* * * * *